US009476323B2

(12) United States Patent
Otto

(10) Patent No.: US 9,476,323 B2
(45) Date of Patent: Oct. 25, 2016

(54) TURBINE GEAR ASSEMBLY SUPPORT HAVING SYMMETRICAL REMOVAL FEATURES

(75) Inventor: John R. Otto, Middletown, CT (US)

(73) Assignee: United Technologies Corporation, Farmington, CT (US)

( * ) Notice: Subject to any disclaimer, the term of this patent is extended or adjusted under 35 U.S.C. 154(b) by 856 days.

(21) Appl. No.: 13/484,878

(22) Filed: May 31, 2012

(65) Prior Publication Data

US 2013/0319000 A1 Dec. 5, 2013

(51) Int. Cl.

| | |
|---|---|
| ***F01D 25/28*** | (2006.01) |
| ***F01D 5/02*** | (2006.01) |
| ***F01D 15/12*** | (2006.01) |
| ***F01D 25/24*** | (2006.01) |

(52) U.S. Cl.

CPC ..... *F01D 25/28* (2013.01); *F01D 5/026* (2013.01); *F01D 15/12* (2013.01); *F01D 25/24* (2013.01); *Y10T 29/49229* (2015.01); *Y10T 29/49233* (2015.01)

(58) Field of Classification Search

CPC ..... F01D 15/12; F01D 25/24; F01D 25/28; Y10T 29/49233

USPC ..... 60/226.1, 262, 796, 798; 29/889.2, 29/889.21; 74/606 R; 415/122.1, 213.1, 415/241.1; 416/170 R

See application file for complete search history.

(56) References Cited

U.S. PATENT DOCUMENTS

| | | | | |
|---|---|---|---|---|
| 1,858,238 A | * | 5/1932 | Cornwell | 29/264 |
| 2,253,241 A | * | 8/1941 | MacDonald | 411/186 |
| 3,287,906 A | | 11/1966 | McCormick | |
| 3,720,060 A | * | 3/1973 | Davies et al. | 60/226.1 |
| 3,761,205 A | * | 9/1973 | Cronstedt | 417/407 |
| 4,747,360 A | | 5/1988 | Tuncel et al. | |
| 5,220,784 A | * | 6/1993 | Wilcox | 60/796 |
| 5,230,540 A | * | 7/1993 | Lewis et al. | 285/363 |
| 5,915,917 A | | 6/1999 | Eveker et al. | |

(Continued)

FOREIGN PATENT DOCUMENTS

| | | |
|---|---|---|
| EP | 1550814 A2 | 7/2005 |
| EP | 2339146 A1 | 6/2011 |

(Continued)

OTHER PUBLICATIONS

Mancuso, Jon and Jones, Roger, "Coupling Interface Connections", Proceedings of the 30th Turbomachinery Symposium, Turbomachinery Laboratory, Texas A&M University, College Station, Texas, 2001, pp. 121-138.*

(Continued)

*Primary Examiner* — Lorne Meade
(74) *Attorney, Agent, or Firm* — Carlson, Gaskey & Olds

(57) ABSTRACT

An exemplary gear assembly support for use in a gas turbine engine includes a support member having a portion that is configured to be coupled to a gear assembly. Another portion of the support member is configured to be coupled to a housing in a gas turbine engine. The support member includes a plurality of removal features that each have a plurality of engaging surfaces to facilitate a pulling force on the support member in a direction parallel to an axis through a center of the support member. The engaging surfaces on each of the removal features are oriented relative to each other to resist any bending moment on the support member during application of the pulling force.

14 Claims, 4 Drawing Sheets

(56) References Cited

U.S. PATENT DOCUMENTS

| | | | | |
|---|---|---|---|---|
| 6,581,265 | B2 * | 6/2003 | Sawaya | 29/426.5 |
| 7,490,460 | B2 * | 2/2009 | Moniz et al. | 60/268 |
| 7,779,540 | B2 * | 8/2010 | McCaffrey et al. | 29/889.2 |
| 7,926,260 | B2 | 4/2011 | Sheridan et al. | |
| 7,950,151 | B2 | 5/2011 | Duong et al. | |
| 7,955,046 | B2 * | 6/2011 | McCune et al. | 415/122.1 |
| 8,585,538 | B2 * | 11/2013 | Sheridan | F01D 25/18 475/346 |
| 2003/0114267 | A1 | 6/2003 | Poulin et al. | |
| 2008/0006018 | A1 | 1/2008 | Sheridan et al. | |
| 2008/0098713 | A1 | 5/2008 | Orlando et al. | |
| 2009/0010754 | A1 | 1/2009 | Kumar et al. | |
| 2009/0090096 | A1 | 4/2009 | Sheridan | |
| 2010/0105516 | A1 * | 4/2010 | Sheridan | F01D 25/18 475/346 |
| 2010/0148396 | A1 | 6/2010 | Xie et al. | |
| 2010/0247306 | A1 | 9/2010 | Merry et al. | |
| 2010/0331139 | A1 | 12/2010 | McCune | |
| 2011/0130246 | A1 | 6/2011 | McCune et al. | |
| 2011/0286836 | A1 | 11/2011 | Davis | |
| 2012/0121378 | A1 | 5/2012 | Sheridan et al. | |
| 2013/0287553 | A1 | 10/2013 | Coffin et al. | |

FOREIGN PATENT DOCUMENTS

| | | |
|---|---|---|
| GB | 1516041 | 6/1978 |
| GB | 2041090 | 9/1980 |
| WO | 2007038674 | 4/2007 |

OTHER PUBLICATIONS

McMillian, A. (2008) Material development for fan blade containment casing. Abstract. p. 1. Conference on Engineering and Physics: Synergy for Success 2006. Journal of Physics: Conference Series vol. 105. London, UK. Oct. 5, 2006.

Kurzke, J. (2009). Fundamental differences between conventional and geared turbofans. Proceedings of ASME Turbo Expo: Power for Land, Sea, and Air. 2009, Orlando, Florida. pp. 145-153.

Agarwal, B.D and Broutman, L.J. (1990). Analysis and performance of fiber composites, 2nd Edition. John Wiley & Sons, Inc. New York: New York. pp. 1-30, 50-51, 56-58, 60-61, 64-71, 87-89, 324-329, 436-437.

Carney, K., Pereira, M. Revilock, and Matheny, P. (2003). Jet engine fan blade containment using two alternate geometries. 4th European LS-DYNA Users Conference. pp. 1-10.

Brines, G.L. (1990). The turbofan of tomorrow. Mechanical Engineering: The Journal of the American Society of Mechanical Engineers,108(8), 65-67.

Faghri, A. (1995). Heat pipe and science technology. Washington, D.C.: Taylor & Francis. pp. 1-60.

Hess, C. (1998). Pratt & Whitney develops geared turbofan. Flug Revue 43(7). Oct. 1998.

Grady, J.E., Weir, D.S., Lamoureux, M.C., and Martinez, M.M. (2007). Engine noise research in NASA's quiet aircraft technology project. Papers from the International Symposium on Air Breathing Engines (ISABE). 2007.

Griffiths, B. (2005). Composite fan blade containment case. Modem Machine Shop. Retrieved from: http://www.mmsonline.com/articles/composite-fan-blade-containment-case pp. 1-4.

Hall, C.A. and Crichton, D. (2007). Engine design studies for a silent aircraft. Journal of Turbomachinery, 129, 479-487.

Haque, A. and Shamsuzzoha, M., Hussain, F., and Dean, D. (2003). S20-glass/epoxy polymer nanocomposites: Manufacturing, structures, thermal and mechanical properties. Journal of Composite Materials, 37 (20), 1821-1837.

Brennan, P.J. and Kroliczek, E.J. (1979). Heat pipe design handbook. Prepared for National Aeronautics and Space Administration by B & K Engineering, Inc. Jun. 1979. pp. 1-348.

Horikoshi, S. and Serpone, N. (2013). Introduction to nanoparticles. Microwaves in nanoparticle synthesis. Wiley-VCH Verlag GmbH & Co. KGaA. pp. 1-24.

Kerrebrock, J.L. (1977). Aircraft engines and gas turbines. Cambridge, MA: The MIT Press. p. 11.

Xie, M. (2008). Intelligent engine systems: Smart case system. NASA/CR-2008-215233. pp. 1-31.

Knip, Jr., G. (1987). Analysis of an advanced technology subsonic turbofan incorporating revolutionary materials. NASA Technical Memorandum. May 1987. pp. 1-23.

Willis, W.S. (1979). Quiet clean short-haul experimental engine (QCSEE) final report. NASA/CR-159473 pp. 1-289.

Kojima, Y., Usuki, A. Kawasumi, M., Okada, A., Fukushim, Y., Kurauchi, T., and Kamigaito, O. (1992). Mechanical properties of nylon 6-clay hybrid. Journal of Materials Research, 8(5), 1185-1189.

Kollar, L.P. and Springer, G.S. (2003). Mechanics of composite structures. Cambridge, UK: Cambridge University Press. p. 465.

Ramsden, J.M. (Ed). (1978). The new European airliner. Flight International, 113(3590). Jan. 7, 1978. pp. 39-43.

Langston, L. and Faghri, A. Heat pipe turbine vane cooling. Prepared for Advanced Turbine Systems Annual Program Review. Morgantown, West Virginia. Oct. 17-19, 1995. pp. 3-9.

Oates, G.C. (Ed). (1989). Aircraft propulsion systems and technology and design. Washington, D.C.: American Institute of Aeronautics, Inc. pp. 341-344.

Lau, K., Gu, C., and Hui, D. (2005). A critical review on nanotube and nanotube/nanoclay related polymer composite materials. Composites: Part B 37(2006) 425-436.

Shorter Oxford English dictionary, 6th Edition. (2007). vol. 2, N-Z. p. 1888.

Lynwander, P. (1983). Gear drive systems: Design and application. New York, New York: Marcel Dekker, Inc. pp. 145, 355-358.

Sweetman, B. and Sutton, O. (1998). Pratt & Whitney's surprise leap. Interavia Business & Technology, 53.621, p. 25.

Mattingly, J.D. (1996). Elements of gas turbine propulsion. New York, New York: McGraw-Hill, Inc. pp. 8-15.

Pyrograf-III Carbon Nanofiber. Product guide. Retrieved Dec. 1, 2015 from: http://pyrografproducts.com/Merchant5/merchant.mvc?Screen=cp_nanofiber.

Nanocor Technical Data for Epoxy Nanocomposites using Nanomer 1.30E Nanoclay. Nnacor, Inc. Oct. 2004.

Ratna, D. (2009). Handbook of thermoset resins. Shawbury, UK: iSmithers. pp. 187-216.

Wendus, B.E., Stark, D.F., Holler, R.P., and Funkhouser, M.E. (2003). Follow-on technology requirement study for advanced subsonic transport. NASA/CR-2003-212467. pp. 1-37.

Silverstein, C.C., Gottschlich, J.M., and Meininger, M. The feasibility of heat pipe turbine vane cooling. Presented at the International Gas Turbine and Aeroengine Congress and Exposition, The Hague, Netherlands. Jun. 13-16, 1994.pp. 1-7.

Merriam-Webster's collegiate dictionary, 11th Ed. (2009). p. 824.

Merriam-Webster's collegiate dictionary, 10th Ed. (2001). p. 1125-1126.

Whitaker, R. (1982). ALF 502: plugging the turbofan gap. Flight International, p. 237-241, Jan. 30, 1982.

Hughes, C. (2010). Geared turbofan technology. NASA Environmentally Responsible Aviation Project. Green Aviation Summit. NASA Ames Research Center. Sep. 8-9, 2010. pp. 1-8.

Gliebe, P.R. and Janardan, B.A. (2003). Ultra-high bypass engine aeroacoustic study. NASA/CR-2003-21252. GE Aircraft Engines, Cincinnati, Ohio. Oct. 2003. pp. 1-103.

Moxon, J. How to save fuel in tomorrow's engines. Flight International. Jul. 30, 1983. 3873(124). pp. 272-273.

Extended European Search Report for Application No. EP 13 79 6961 dated Feb. 11, 2016.

International Search Report and Written Opinion of the International Searching Authority for International application No. PCT/US2013/042355 dated Sep. 12, 2013.

International Preliminary Report on Patentability for International application No. PCT/US2013/042355 dated Dec. 11, 2014.

* cited by examiner

TURBINE GEAR ASSEMBLY SUPPORT HAVING SYMMETRICAL REMOVAL FEATURES

BACKGROUND

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. A direct drive gas turbine engine includes a fan section driven by the low spool such that the low pressure compressor, low pressure turbine and fan section rotate at a common speed in a common direction.

A speed reduction device such as an epicyclical gear assembly may be utilized to drive the fan section such that the fan section may rotate at a speed different than the turbine section so as to increase the overall propulsive efficiency of the engine. In such engine architectures, a shaft driven by one of the turbine sections provides an input to the epicyclical gear assembly that drives the fan section at a reduced speed such that the turbine section and the fan section can rotate at closer to respective optimal speeds.

SUMMARY

An exemplary gear assembly support for use in a gas turbine engine includes a support member having an inner portion and an outer portion. One of the portions is configured to be coupled to a gear assembly and the other of the portions is configured to be coupled to a housing in a gas turbine engine. The support member includes a plurality of removal features each having a plurality of engaging surfaces to facilitate a pulling force on the support member in a direction parallel to an axis through a center of the support member. The engaging surfaces on each of the removal features are oriented relative to each other to resist any bending moment on the support member during application of the pulling force.

In an example embodiment having one or more features of the embodiment of the preceding paragraph, the removal features each comprise a stem and a cross member and the engaging surfaces are on the cross member on opposite sides of the stem.

In an example embodiment having one or more features of any of the embodiments of the preceding paragraphs, one of the engaging surfaces is on a side of the stem facing toward the center of the support member and the other of the engaging surfaces is on a side of the stem facing away from the center of the support member.

In an example embodiment having one or more features of any of the embodiments of the preceding paragraphs, the removal features have a generally T-shaped cross-section.

In an example embodiment having one or more features of any of the embodiments of the preceding paragraphs, the support member comprises an annular body and the removal features are circumferentially and symmetrically spaced from each other on the support member.

In an example embodiment having one or more features of any of the embodiments of the preceding paragraphs, the portion of the support member that is configured to be coupled to a housing in a gas turbine engine comprises a plurality of mounting tabs, and there is at least one removal feature situated near each of the mounting tabs.

In an example embodiment having one or more features of any of the embodiments of the preceding paragraphs, the support includes a plurality of bolts that are at least partially received by the mounting tabs in an orientation wherein the bolts are accessible from one side of the support member and the removal features are accessible from the one side of the support member.

In an example embodiment having one or more features of any of the embodiments of the preceding paragraphs, the engaging surfaces on each of the removal features are oriented relative to each other to resist any bending moment on the mounting tabs during application of the pulling force.

In an example embodiment having one or more features of any of the embodiments of the preceding paragraphs, the support member is at least partially flexible.

An exemplary gas turbine engine includes a fan having a plurality of fan blades rotatable about an axis, a compressor section, a combustor in fluid communication with the compressor section, and a turbine section in fluid communication with the combustor. A geared architecture is configured to be driven by the turbine section for rotating the fan about the axis. A support member supports the geared architecture within the gas turbine engine. The support member includes a plurality of removal features each having a plurality of engaging surfaces to facilitate a pulling force on the support member in a direction parallel to the axis. The engaging surfaces on each of the removal features are oriented relative to each other to resist any bending moment on the support member during application of the pulling force.

In an example embodiment having one or more features of the embodiment of the preceding paragraph, the removal features each comprise a stem and a cross member and the engaging surfaces are on the cross member on opposite sides of the stem.

In an example embodiment having one or more features of any of the embodiments of the preceding paragraphs, one of the engaging surfaces is on a side of the stem facing toward the axis and the other of the engaging surfaces is on a side of the stem facing away from the axis.

In an example embodiment having one or more features of any of the embodiments of the preceding paragraphs, the removal features have a generally T-shaped cross-section.

In an example embodiment having one or more features of any of the embodiments of the preceding paragraphs, the support member comprises an annular body and the removal features are circumferentially and symmetrically spaced from each other on the support member.

In an example embodiment having one or more features of any of the embodiments of the preceding paragraphs, the support member comprises a plurality of mounting tabs and there is at least one removal feature situated near each of the mounting tabs.

In an example embodiment having one or more features of any of the embodiments of the preceding paragraphs, the support member has an associated plurality of bolts that are at least partially received by the mounting tabs in an orientation wherein the bolts and the removal features are accessible from a front of the gas turbine engine.

In an example embodiment having one or more features of any of the embodiments of the preceding paragraphs, the engaging surfaces on each of the removal features are oriented relative to each other to resist any bending moment on the mounting tabs during application of the pulling force.

An exemplary method of servicing a gas turbine engine is intended for a gas turbine engine that includes a fan that is rotatable about an axis, a geared architecture for rotating the fan about the axis, and a support member that supports the geared architecture within the gas turbine engine. The exemplary method includes accessing a plurality of removal features on the support member from a front of the gas turbine engine and exerting a pulling force on at least some of the support members in a direction parallel to the axis and toward the front of the gas turbine engine. Each of the support members has a plurality of engaging surfaces oriented relative to each other to resist any bending moment on the support member responsive to the pulling force.

In an example embodiment having one or more features of the embodiment of the preceding paragraph, the method includes removing the support member and the geared architecture from the gas turbine engine through the front of the gas turbine engine.

In an example embodiment having one or more features of any of the embodiments of the preceding paragraphs, the support member includes a plurality of bolts for securing the support member within the gas turbine engine. The method includes accessing the bolts from the front of the gas turbine engine and manipulating the bolts to permit movement of the support member relative to the gas turbine engine prior to exerting the pulling force.

The various features and advantages of disclosed examples will become apparent to those skilled in the art from the following detailed description. The drawings that accompany the detailed description can be described as follows.

DETAILED DESCRIPTION

Figure 1:
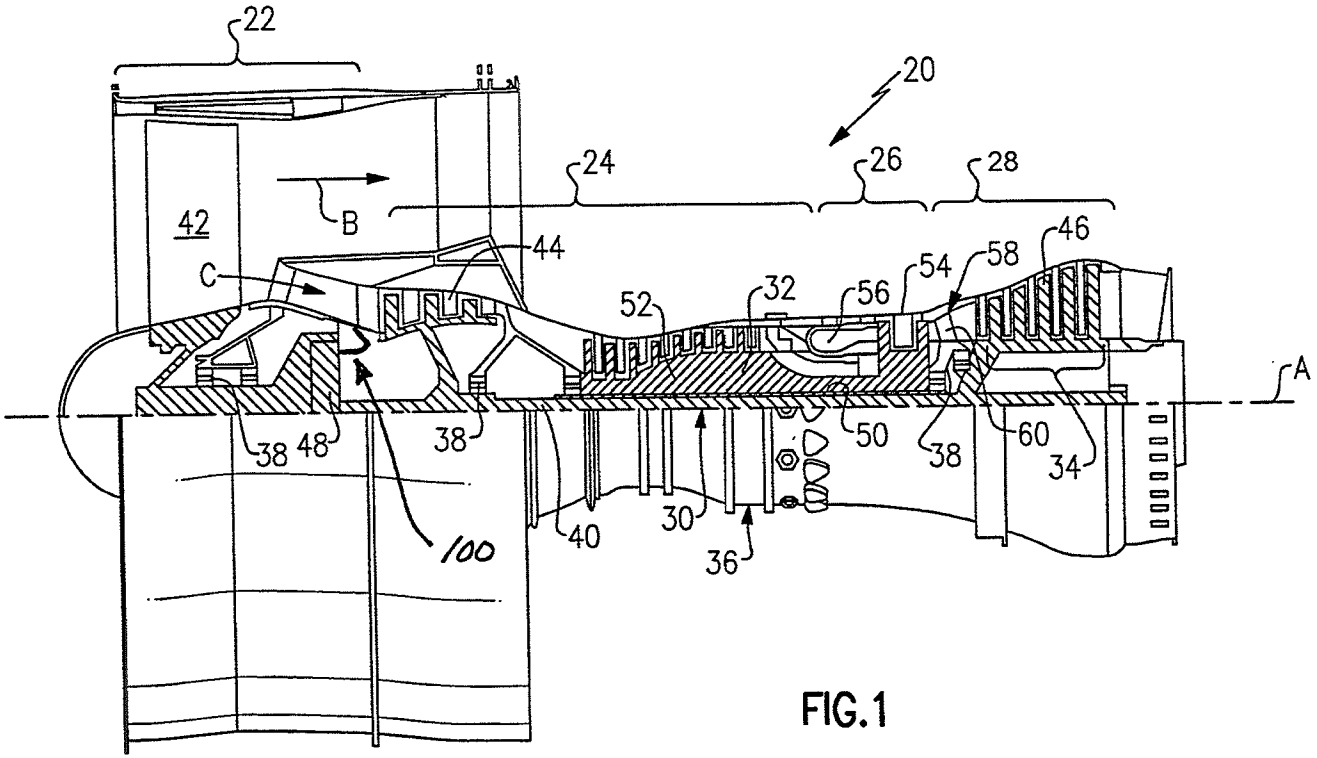
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to the combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts disclosed in this description and the accompanying drawings are not limited to use with turbofans as the teachings may be applied to other types of turbine engines, such as a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used in this description, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 and sets airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram } ^\circ\text{R})/518.7)^{0.5}]$. The "Low corrected fan tip speed", according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
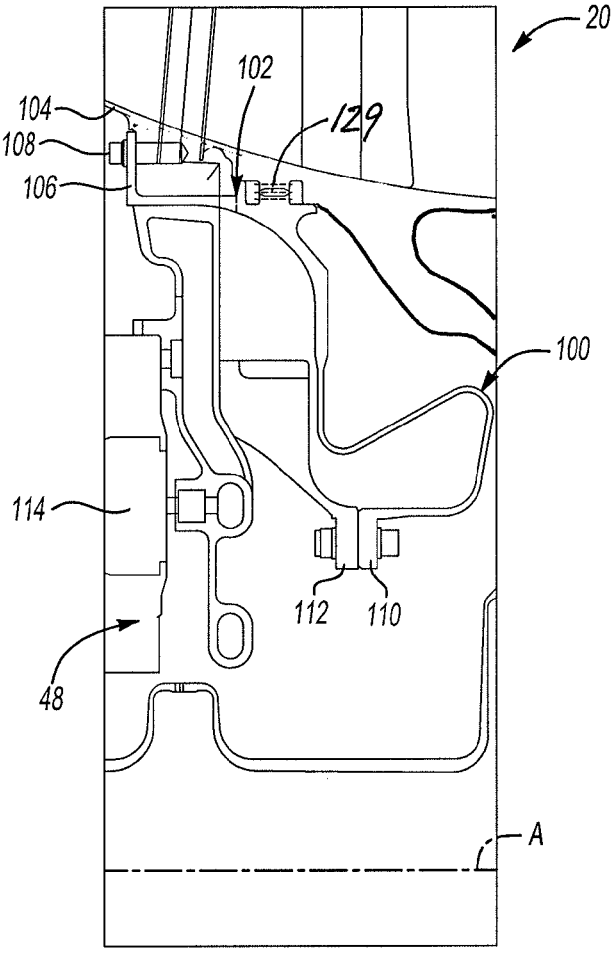
FIG. 2 schematically illustrates selected portions of an example gear assembly support within an example gas turbine engine.

FIG. 2 illustrates selected portions of a gas turbine engine 20 that includes a gear assembly support member 100 for supporting the geared architecture 48 within the engine 20. In this example, the support member 100 includes a first portion 102 that is configured to be coupled to a housing 104 within the engine 20. The illustrated example first portion 102 includes a plurality of mounting flanges 106. A plurality of bolts 108 are at least partially received through openings in the mounting flanges 106 for securing the support member 100 to the housing 104. In the illustrated example, the bolts 108 are accessible from a front of the engine 20 (e.g., from the left in FIG. 1).

The support member 100 includes a second portion 110 that is configured to be coupled to the geared architecture 48. In this example, a portion 112 of the geared architecture 48 is received against and secured to the second portion 110 of the support member 100. In the illustrated example, the support member 100 provides the support to a component 114 of the geared architecture 48 for supporting that geared architecture within the engine 20. In one example, the component 114 comprises a bearing within the geared architecture 48.

In some examples, the support member 100 is at least partially flexible for supporting the geared architecture 48 within the engine 20 in a manner that accommodates some, limited relative movement between the geared architecture 48 and the axis A resulting from forces associated with operation of the engine.

Figure 3:
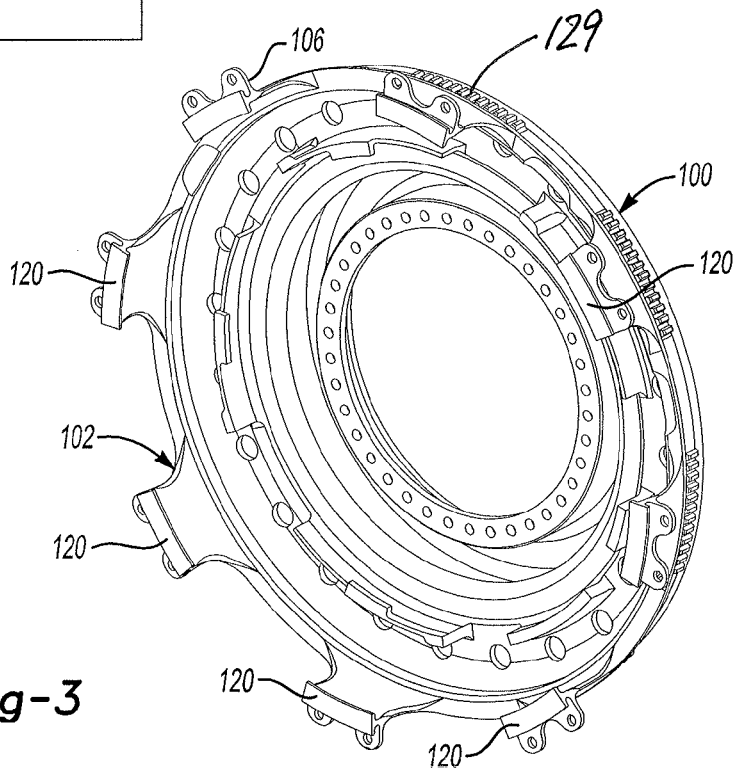
FIG. 3 is a perspective, diagrammatic illustration of an example gear assembly support.
Figure 4:
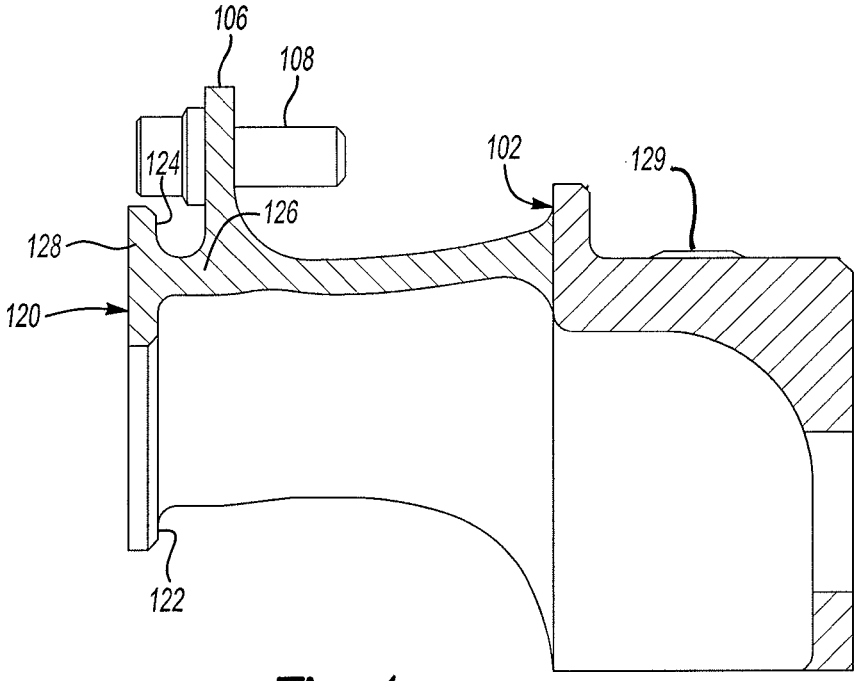
FIG. 4 illustrates selected features of the example of FIG. 3.

FIGS. 3 and 4 illustrate an example embodiment of the support member 100. The support member 100 comprises an annular body and includes a plurality of removal features 120 that facilitate removing the support member 100 and the associated geared architecture 48 from the front of the gas turbine engine. As can be appreciated from FIG. 3, each of the mounting flanges 106 has an associated removal feature 120. The mounting flanges 106 and the removal features 120 are equally and circumferentially spaced from each other. In this example, the removal features 120 are near an outer periphery of the support member 100.

The example removal features 120 include reaction surfaces 122 and 124 that are oriented relative to each other to resist any bending moment on the support member 100 while a pulling force is exerted on the engagement surfaces 122 and 124. In the illustrated example, each of the removal features 120 includes a stem 126 and a cross member 128. In this example, the stem 126 is generally perpendicular to the mounting flange 106 with which the removal feature 120 is associated. The reaction surfaces 122 and 124 are situated on the cross member 128 in the illustrated example. In the illustrated example, each of the removal features 120 has a generally T-shaped cross section, effectively forming a T-beam, with the cross member forming the flange and the step forming the web, and which is connected via its web to the support member 100.

The reaction surfaces 122 and 124 are symmetrically situated relative to the stem 126. The reaction surface 122 is on a side of the stem that faces toward a center of the support member 100 (i.e., toward the axis A when the support member is situated within a gas turbine engine). The reaction surface 124 is on an opposite side of the stem 126 (i.e., on a side of the stem 126 that faces away from the axis A when the support member 100 is situated within a gas turbine engine).

Figure 5:
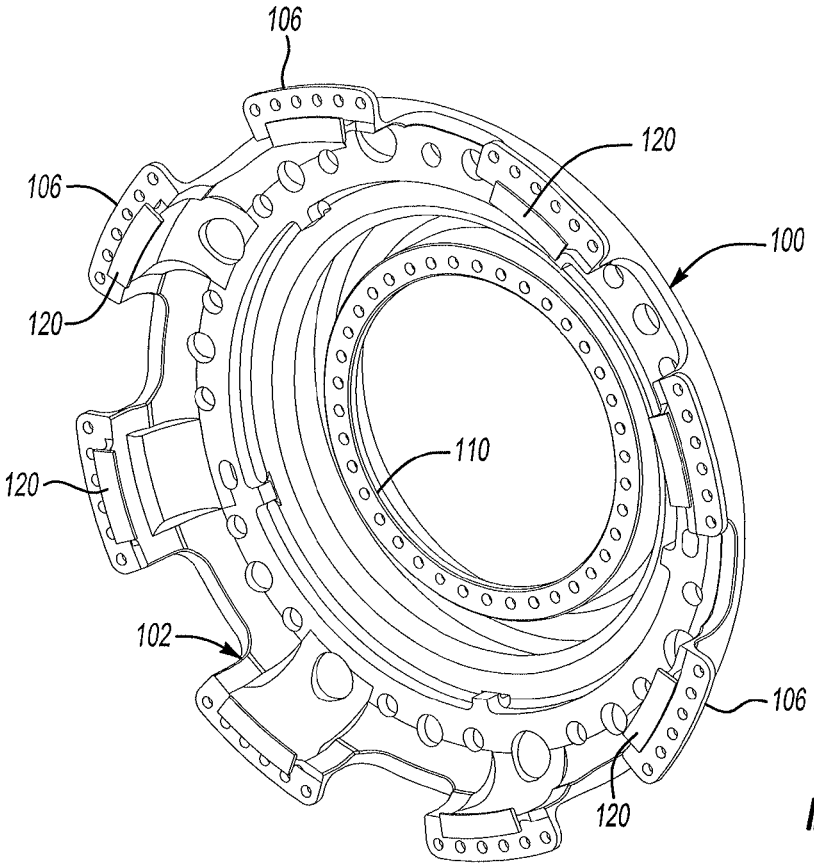
FIG. 5 is a perspective, diagrammatic illustration of another example gear assembly support.
Figure 6:
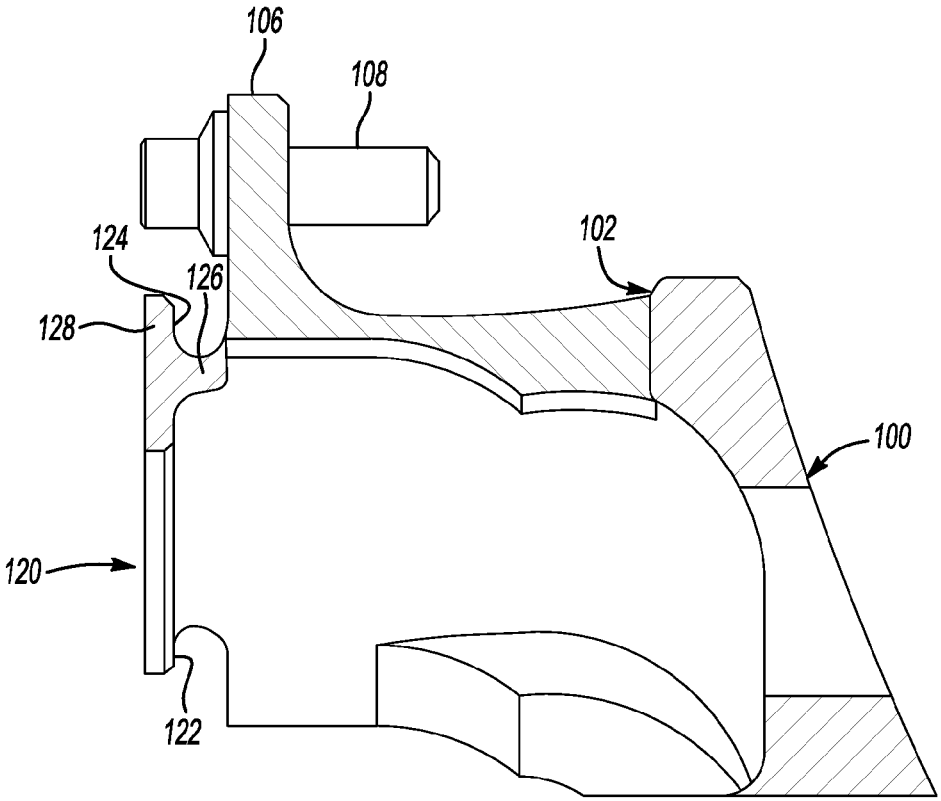
FIG. 6 illustrates selected features of the example of FIG. 5.

FIGS. 5 and 6 illustrate another example embodiment. The removal features 120 in this example are the same as those described above and shown in FIGS. 3 and 4. In this example, torque is reacted to the housing 104 through the mounting flanges 106, which establish the primary load path to the housing 104. In FIGS. 3 and 4 torque is reacted to the housing 104 via splines 129.

Figure 7:
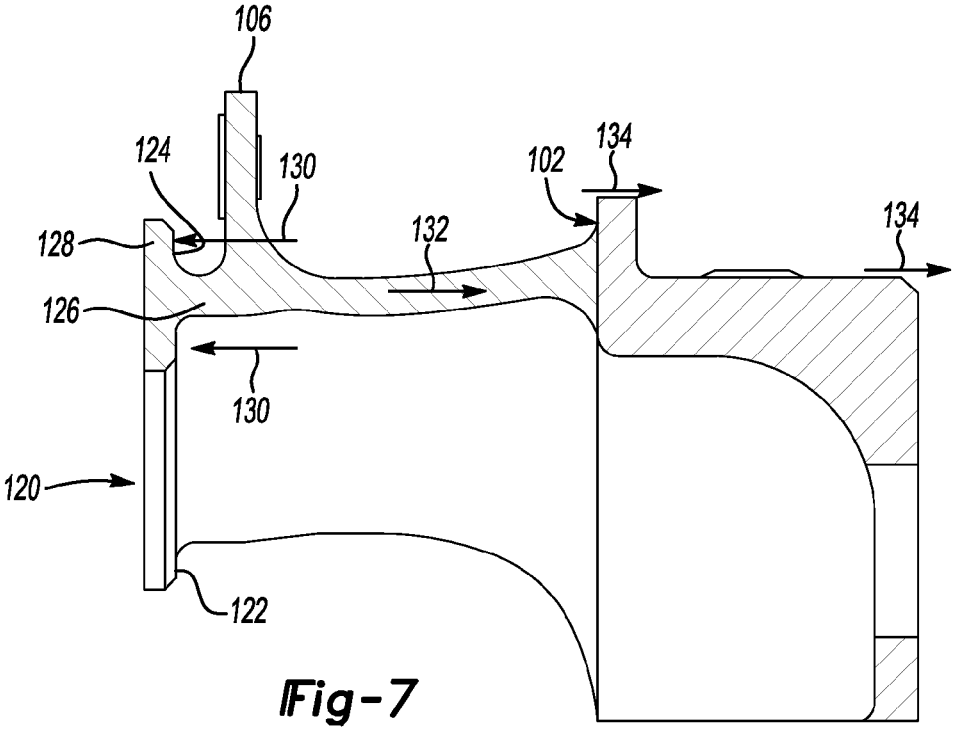
FIG. 7 schematically illustrates force distribution in an example consistent with the examples shown in FIGS. 3 and 4.

FIG. 7 schematically illustrates an applied pulling force 130 that is useful for removing the support member 100 and the associated geared architecture 48 from a gas turbine engine. In examples where the removal features 120 and the bolts 108 are accessible from a front of the engine, such removal is relatively more easily accomplished because it involves disassembly or removal of fewer components within the engine. Given the symmetrical arrangement of the reaction surfaces 122 and 124 (e.g., on both sides of the stem 126), a reaction force schematically shown at 132 is parallel to the axis A (see, for example, FIG. 2). Having the reaction force 132 aligned with the pulling force schematically shown at 130 and the axis A minimizes or avoids any bending moment on the support member 100 during application of the pulling force. The separation forces associated with separating the support member 100 from the housing 104 are schematically shown at 134. Those forces 134 are also generally aligned with the pulling force 130 and the axis A.

The arrangement of the reaction surfaces 122 and 124 on the removal features 120 facilitates force distribution that minimizes or avoids any bending moments on the support member 100 when a pulling force is applied to the reaction surfaces. This avoids any bending or non-axial movement of portions of the support member 100 during application of a pulling force. Avoiding bending or non-axial movement facilitates avoiding any damage to the housing 104 or nearby structures within the gas turbine engine during a maintenance or repair procedure that involves removing the geared architecture from the engine 20.

In the illustrated examples, the removal features 120 are established during a process of making the support member 100. The example removal features 120 are an integral part of the support member 100 and comprise the same material used for making the support member 100. In one example, the support member 100 and the removal features 120 comprise stainless steel.

Although the different examples have the specific components shown in the illustrations, embodiments of this invention are not limited to those particular combinations. It is possible to use some of the components or features from one of the examples in combination with features or components from another one of the examples.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A method of servicing a gas turbine engine that includes a fan that is rotatable about an axis, a geared architecture for rotating the fan about the axis, and a support member that supports the geared architecture within the gas turbine engine, the method comprising:

accessing a plurality of removal features on the support member from a position in front of the gas turbine engine; and exerting a pulling force on at least some of the removal features in a direction parallel to the axis from the position in front of the gas turbine engine, each of the removal features having a plurality of engaging surfaces oriented relative to each other to resist any bending moment on the support member responsive to the pulling force.

2. The method of claim 1, comprising removing the support member and the geared architecture from the gas turbine engine through the front of the gas turbine engine.

3. The method of claim 2, wherein the support member includes a plurality of bolts for securing the support member within the gas turbine engine and the method comprises:

accessing the bolts from the front of the gas turbine engine; and manipulating the bolts to permit movement of the support member relative to the gas turbine engine prior to exerting the pulling force.

4. The method of claim 1, wherein the support member has an inner portion and an outer portion, one of the inner portion or the outer portion being configured to be coupled to a gear assembly of the geared architecture and the other of the inner portion or the outer portion being configured to be coupled to a housing in the gas turbine engine.

5. The method of claim 4, wherein the removal features each have a plurality of engaging surfaces facing in a first direction opposite to the direction of the pulling force;

the removal features each comprise a stem and a cross member; and the engaging surfaces are on the cross member on opposite sides of the stem.

6. The method of claim 5, wherein one of the engaging surfaces is on a side of the stem facing toward the center of the support member; and another one of the engaging surfaces is on a side of the stem facing away from the center of the support member.

7. The method of claim 5, wherein the removal features have a generally T-shaped cross-section.

8. The method of claim 1, wherein the support member comprises an annular body; and the removal features are circumferentially and symmetrically spaced from each other on the support member.

9. The method of claim 1, wherein the support member comprises a plurality of mounting tabs; and there is at least one removal feature associated with each of the mounting tabs.

10. The method of claim 9, wherein there is a plurality of bolts at least partially received by the mounting tabs in an orientation wherein the bolts are accessible from the position in front of the gas turbine engine; and the removal features are distinct from the bolts.

11. The method of claim 9, wherein the engaging surfaces on each of the removal features resist any bending moment on the mounting tabs during application of the pulling force.

12. The method of claim 1, wherein the support member is at least partially flexible.

13. The method of claim 1, wherein the support member comprises a plurality of splines situated for engaging another portion of the gas turbine engine.

14. The method of claim 2, wherein the support member includes a plurality of fasteners for securing the support member within the gas turbine engine and the method comprises:

accessing the fasteners from the front of the gas turbine engine; and manipulating the fasteners to permit movement of the support member relative to the gas turbine engine prior to exerting the pulling force.

* * * * *